US005860163A

United States Patent [19]

Aldridge

[11] Patent Number: 5,860,163

[45] Date of Patent: Jan. 19, 1999

[54] GARMENT THERMAL LINER HAVING INSULATING BEADS

[75] Inventor: Donald Aldridge, New Carlisle, Ohio

[73] Assignee: Lion Apparel, Inc., Dayton, Ohio

[21] Appl. No.: 651,689

[22] Filed: May 21, 1996

[51] Int. Cl.[6] ..... A41D 13/00

[52] U.S. Cl. ..... 2/81; 2/97; 2/458

[58] Field of Search ..... 2/81, 97, 458, 2/2.16, 86, 272

[56] References Cited

U.S. PATENT DOCUMENTS

| | | | |
|---|---|---|---|
| 4,502,153 | 3/1985 | Lapedes et al. | 2/81 |
| 4,810,559 | 3/1989 | Fortier et al. | 2/272 |
| 4,897,886 | 2/1990 | Grilliot et al. | 2/81 |
| 4,994,317 | 2/1991 | Dugan et al. | 428/246 |
| 5,098,770 | 3/1992 | Paire | 2/272 |
| 5,140,721 | 8/1992 | Kauffeld | 2/458 |
| 5,236,769 | 8/1993 | Paire | 428/196 |
| 5,359,735 | 11/1994 | Stockwell | 2/243.1 |

FOREIGN PATENT DOCUMENTS

| | | | |
|---|---|---|---|
| 2270829 | 3/1994 | United Kingdom | 2/458 |

*Primary Examiner*—Diana L. Biefeld
*Attorney, Agent, or Firm*—Thompson Hine & Flory LLP

[57] ABSTRACT

A lightweight thermal liner suitable for use with a garment which provides thermal protection for the garment without the stiffness and bulk of conventional prior art thermal liners. In a preferred embodiment, the thermal liner includes a fabric substrate and a layer of relatively incompressible, lightweight insulating beads bonded to the substrate. The insulating beads are spaced on the substrate in a spaced array and create an insulating air space between the substrate and an adjacent layer of material in the garment. Also in a preferred embodiment, the thermal liner is made of flame and heat resistant material such as aramid or PBI fibers.

42 Claims, 6 Drawing Sheets

GARMENT THERMAL LINER HAVING INSULATING BEADS

The present invention relates to garment thermal liners and, more particularly, to lightweight thermal liners for cold weather and hazardous duty garments to provide thermal protection for a wearer.

Outer garments used by utility workers, firefighters, factory emergency workers and the like often are designed to provide thermal protection in hot and cold environments, as well as provide the wearer protection from injury from short bursts of flame, blasts of superheated air, steam and sparks. For example, such garments adapted to be worn by firefighters typically include an outer shell, a moisture barrier and a thermal liner which cooperate to protect against abrasion, moisture and temporary bursts of heat and flame.

One typical firefighting ensemble comprises a turnout coat and pant or coveralls, each of which has an outer shell, a moisture barrier located within the outer shell, and a thermal liner. The outer shell typically is constructed of a flame and heat resistant material such as woven fabric of aramid and/or polybenzamidazole ("PBI") fibers. Commercially available aramid fibers are NOMEX and KEVLAR (both are trademarks of E.I. DuPont de Nemours & Co., Inc.). The moisture barrier typically includes a membrane layer, which is moisture vapor permeable but is impermeable to liquid moisture and air, bonded to a substrate of a flame and heat resistant material, such as the aramid or PBI material of the outer shell, only lighter in weight. Typically, the moisture barrier is made of expanded polytetrafluoroethylene ("PTFE"), such as GORE-TEX (a trademark of W. L. Gore & Associates, Inc.). The thermal liner is typically positioned within the moisture barrier in order to prevent it from soaking up liquid moisture flowing through the outer shell from the ambient environment and comprises a non-woven or batting of aramid fibers.

A recently-developed firefighting ensemble comprises a turnout coat and pant, or coveralls, having an outer shell, a moisture barrier and a thermal liner positioned between the outer shell and moisture barrier. The thermal liner includes a layer of a flame and heat resistant closed-cell apertured foam attached to a substrate of woven NOMEX by a suitable adhesive. The foam material is a neoprene or polyvinyl nitrile foam treated with antimony oxide to enhance flame and heat resistance. Examples of commercially available suitable foams are ENSOLITE brand closed-cell foam styles IV1, IV2, IV3, IV4, IV5, GIC and IVC, manufactured by Ensolite, Inc. of Mishawaka, Ind.

Each layer of the ensemble must meet National Fire Protection Association ("N.F.P.A.") standard 1971 ("Protective Clothing for Structural Fire Fighting") which includes standards for heat and flame resistance and tear strength. For example, the outer shell must be able to resist burning, melting, dripping, excessive shrinkage and separation at a temperature of 500° F. for five minutes. All layers combined must provide a thermal protection performance ("TPP") rating of at least 35.

The moisture barrier and thermal liner are often stitched together to form a unitary component which is removably attached to the outer shell by snaps and/or hook and loop fasteners. While the combined moisture barrier and thermal liner may be removable from the outer shell, in most cases, this component is not designed to be worn separately apart from the outer shell, because it lacks such items as a front closure mechanism (e.g. a slide fastener), a collar, or an outer layer of material to protect the component from abrasion.

A typical cold-weather ensemble, such as ski apparel, comprises a coat and pant or coveralls, each of which has an outer shell and an inner liner located within the outer shell. Conventionally, the thermal protection provided by the coat results from a synthetic filler or down sandwiched between the outer shell and the inner liner. Such insulation tends to make the garment bulky and consequently, restrict movement by the wearer.

Typically, for both hazardous duty and cold weather garments, the insulation layer accounts for a large percentage of the weight of the garment. Furthermore, since most conventional thermal liners rely on thickness or "loft" from fibers or closed air cells to trap air to provide heat insulation, such liners tend to be bulky, compress easily—resulting in inconsistent thermal protection—and restrict movement of the wearer. Such movement restriction increases the effort required to move while wearing the garment, which increases the level of stress imposed on the wearer. Such stress level increase may become a critical factor when the associated garment is designed for wear by a firefighter, utility worker or emergency worker.

Accordingly, there is a need to provide a garment with a thermal liner which is capable of providing adequate insulation at minimal weight, thickness and bulk. Furthermore, there is a need for such a thermal liner to be resistant to moisture absorption so that it can be positioned outside of a garment moisture barrier, an orientation which enhances moisture vapor transport from the wearer.

SUMMARY OF THE INVENTION

The present invention is a lightweight thermal liner suitable for use with a garment which provides thermal protection for the garment without the stiffness, thickness and bulk of conventional prior art thermal liners. In a preferred embodiment of the invention, the thermal liner comprises a fabric substrate and a layer of relatively incompressible, lightweight insulating beads bonded to the substrate. The insulating beads are positioned on the substrate in a spaced array and create an insulating air space between the substrate and an adjacent layer of material in the garment.

In an embodiment adapted for use in a firefighter garment, the thermal liner is constructed of flame and heat resistant materials such that the thermal liner meets applicable performance criteria of the N.F.P.A. standard (National Fire Protection Association), and the like.

In accordance with one embodiment of the present invention, the thermal liner of the present invention is incorporated into a garment which also includes an outer shell. The thermal liner includes a fabric substrate and a layer of insulating beads bonded to the substrate such that an air gap is created between the outer shell and substrate around the insulating beads. This air gap provides thermal protection for a wearer.

In a second embodiment of the present invention, the thermal liner is incorporated into a firefighter ensemble comprising an outer shell, a face cloth, and a moisture barrier positioned between the outer shell and face cloth. The thermal liner of the present invention is positioned between the outer shell and moisture barrier. With this embodiment, the thermal liner substrate is made of a flame and heat resistant material such as an aramid or PBI fiber. Consequently, both the substrate and beads meet requirements as found in N.F.P.A. type standards such that the entire ensemble meets the relevant N.F.P.A. 1971 performance requirements for a firefighting turnout garment. The moisture barrier includes a substrate and a semi-permeable membrane bonded to the substrate. The substrate can be made from the same material as the fabric substrate of the thermal liner.

In a third embodiment of the present invention, the thermal liner is incorporated in a firefighter garment comprising an outer shell, the thermal liner of the second embodiment and a combination moisture barrier/face cloth. The combination moisture barrier/face cloth comprises a layer of a semi-permeable membrane material, such as GORE-TEX, bonded to a substrate of a filament face cloth. The thermal liner is oriented such that the substrate faces outwardly.

In a fourth embodiment of the present invention, the thermal liner of the present invention is incorporated into an ensemble comprising an outer shell and a combination moisture barrier/face cloth. With this embodiment, the thermal liner includes at least two fabric substrates, each of which carries a spaced array of insulating beads such that the substrates are spaced from each other by the beads. The thermal liner is positioned between the outer shell and the combination moisture barrier/face cloth. Alternately, the combination moisture barrier/face cloth is replaced by a discrete moisture barrier and face cloth.

In a fifth embodiment, a firefighter garment is augmented with patches or pads comprising the thermal liner of the present invention. In one variation, the pads are positioned between the outer shell and thermal liner of the garment in strategic locations, such as the elbow, shoulder yoke or knees and act to increase the thermal resistance in such areas in response to external pressure, as well as add resiliency to those areas in response to increased loading, as from the pads and straps of SCBA Equipment. In other variations, the pads are positioned between the thermal liner and moisture barrier, and/or between the wearer and the face cloth to provide extra insulation in strategic areas. Alternately, such pads can be applied externally of the outer shell by pads covered with a patch of leather or aramid shell material, or can be applied to the outer surface of the outer shell such that the beads face outwardly and are exposed.

The insulating beads employed in the garments preferably are made of silicone and do not appreciably absorb moisture. Consequently, the thermal liner of the present invention can be placed outside of the moisture barrier of a garment, an orientation which enhances moisture vapor transport from the wearer through the moisture barrier.

In addition to the hazardous duty garments described above, the thermal liner of the present invention can be employed in conventional garments as well as career apparel such as coveralls and jumpsuits.

Accordingly, it is an object of the present invention to provide an improved thermal liner which is relatively lightweight and of low bulk; a thermal liner which provides insulation from exterior temperature extremes sufficient to meet hazardous duty requirements and yet promotes breathability of the garment; a thermal liner which can be made of flame and heat resistant materials suitable for use in firefighter garments; a thermal liner which possesses relatively low moisture absorbing characteristics; a thermal liner having greater flexibility than thermal liners of comparable insulating capability; and a thermal liner which is relatively inexpensive and simple to construct.

Other objects and advantages of the present invention will be apparent from the following description, the accompanying drawings and the appended claims.

DETAILED DESCRIPTION

In the following embodiments, the insulating beads are preferably bonded to the fabric substrate of the thermal liner. However, those skilled in the art will appreciate that the insulating beads could be bonded to other layers of material of the garment, such as the outer shell, moisture barrier, and face cloth substrates or combinations thereof.

Figure 1:
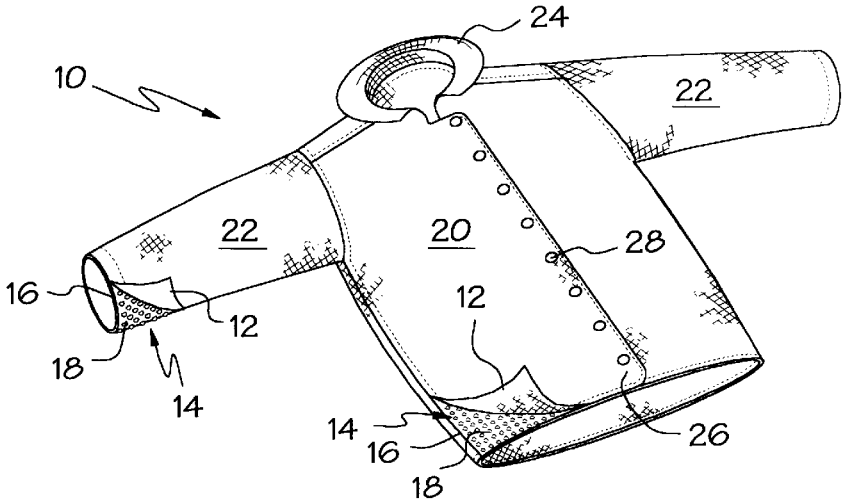
FIG. 1 is a perspective view of a preferred embodiment of the thermal liner of the present invention incorporated in a coat.
Figure 4:
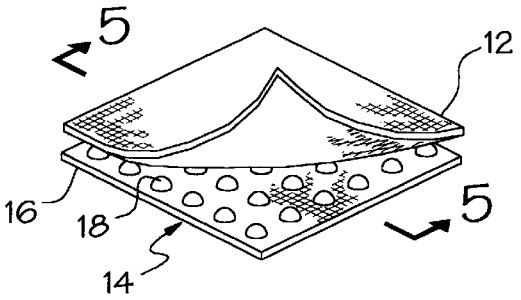
FIG. 4 is a detail view of the garments of FIGS. 1–3.
Figure 5:
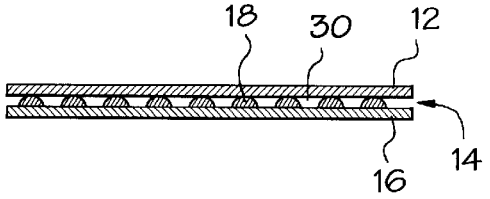
FIG. 5 is a cross sectional view taken at line 5—5 of FIG. 4.

As shown in FIG. 1, the thermal liner of the present invention is embodied in a cold-weather coat, generally designated 10. The coat 10 comprises an outer shell 12 and a thermal liner 14. As also shown in FIGS. 4 and 5, the thermal liner 14 includes a fabric substrate 16 and a layer of relatively incompressible, spaced insulating beads, generally designated 18, bonded to the substrate 16 and sandwiched between the outer shell 12 and the substrate 16 such that the beads face the outer shell. The coat 10 includes a body portion 20, sleeves 22 and a collar 24 attached to the body portion. The outer shell 12 and liner 14 both include a front opening, and the shell includes a front closure 26 which includes snaps 28, or alternatively a slide fastener (not shown).

The outer shell 12 preferably is made from a material, such as nylon, polyester, cotton, or blends thereof, which is either inherently moisture-resistant, or treated to be such. The fabric substrate 16 is made from a suitable material, such as cotton or nylon. The insulating beads 18 are made of polyvinyl chloride, silicone or other suitable material or combinations thereof, such that the beads are relatively incompressible. The beads 18 can be in any shape, such as spherical, tear-drop shaped, elliptical, square, rectangular, triangular, so long as an air gap is created between the fabric substrate 16 and any adjacent layer of material of the garment 10. Preferably, the beads 18 have a generally half-spherical shape, a diameter of about 3 millimeters and a height of about 1 mm. The preferred density of the beads 18 on the substrate 16 is in the range from about 5 to 7 beads per square centimeter.

The insulating beads 18 can be bonded to the fabric substrate 16 by an appropriate adhesive or by self-adhesion upon the deposition of the material forming the beads 18 onto the substrate 16. The beads 18 create an air gap 30 (shown in FIG. 5) around the beads 18 and between the outer shell 12 and substrate 16. This air gap 30 provides thermal insulation, protecting the wearer of the coat 10 from ambient temperature extremes. Additionally, it is within the scope of the present invention that the materials described above for the cold-weather coat may be readily substituted with other materials having similar insulative properties.

Figure 2:
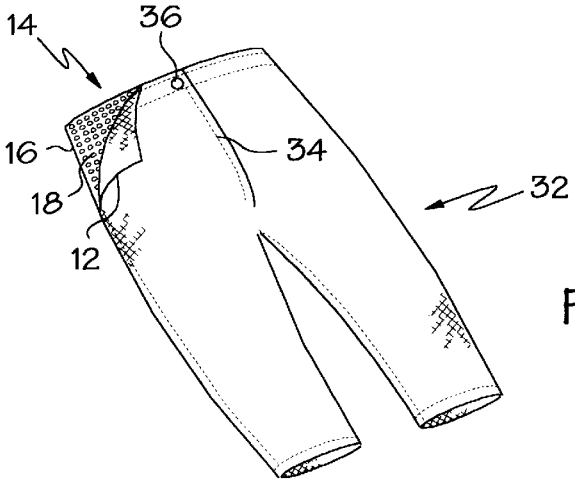
FIG. 2 is a perspective view of the thermal liner of the invention incorporated in a pant.

As shown in FIG. 2, the thermal liner 14 is incorporated in a cold-weather pant, generally designated 32. The pant 32 includes an outer shell 12 which surrounds thermal liner 14. The thermal liner 14 may be attached to the shell 12 by hook and loop fasteners, snaps or the like (not shown). The shell 12 includes a front closure 34 which is secured by snaps 36, or alternatively a slide fastener (not shown). The insulating beads 18 are bonded to the substrate 16 of the thermal liner 14 according to the procedure set forth above. The beads 18 create an air gap 30 (illustrated in FIG. 5) around the beads 18 and between the outer shell 12 and substrate 16. This air gap 30 functions as a thermal protection means, protecting the wearer of the garment 32 from temperatures present in the surrounding environments. The outer shell 12, fabric substrate 16 and insulating beads 18 are made from the same materials as their corresponding elements in the coat 10 described above.

Figure 3:
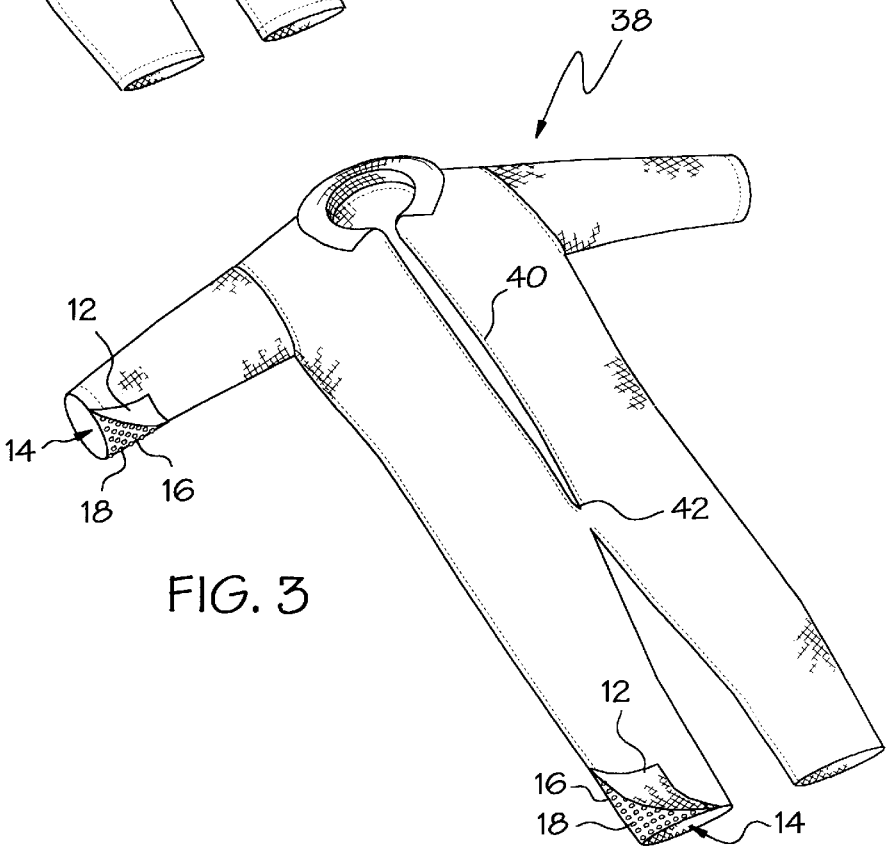
FIG. 3 is a perspective view of a second alternate embodiment of the invention incorporated in a coverall.

As shown in FIG. 3, the thermal liner 14 of the present invention is incorporated into a cold-weather coverall, generally designated 38. The coverall 38 includes an outer shell 12 enclosing the thermal liner 14. The outer shell 12 includes a front closure 40 which is secured by a slide fastener 42, or alternatively by snaps (not shown). The insulating beads 18 are bonded to the substrate 16 according to the procedure set forth above. The outer shell 12, fabric substrate 16 and insulating beads 18 preferably are made from the same materials as their corresponding elements in the coat 10 and pant 32 described above.

Figure 6:
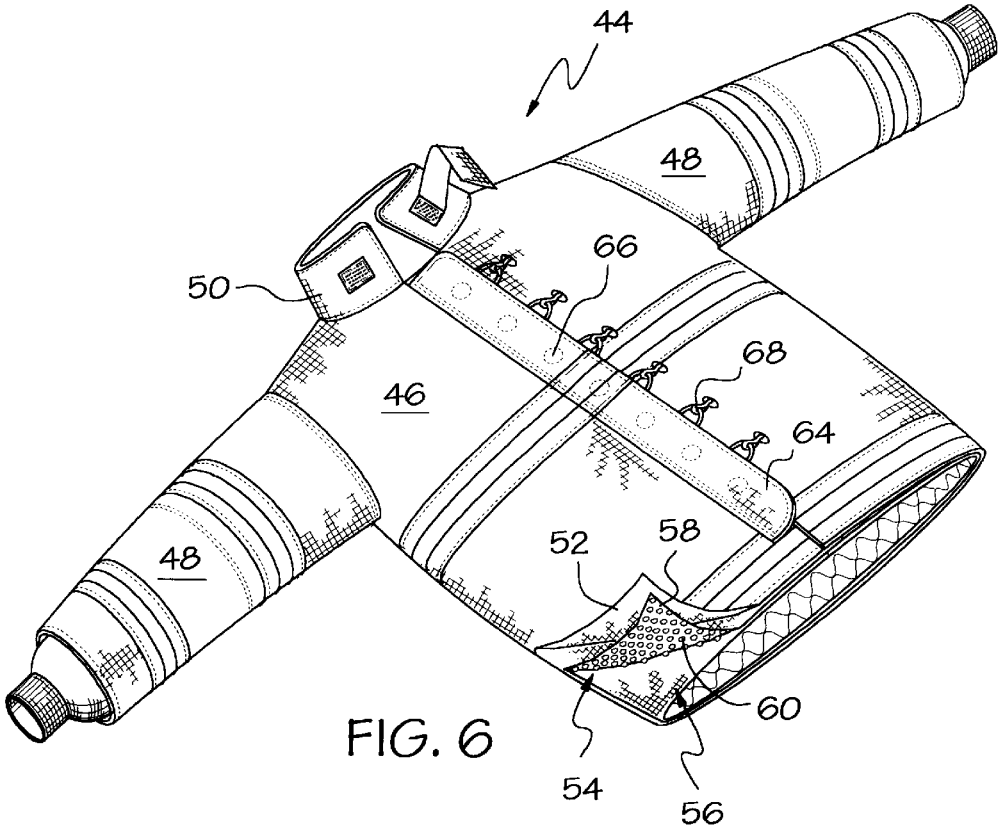
FIG. 6 is a perspective view of a fourth alternate embodiment of the thermal liner of the present invention incorporated in a firefighter turnout coat.
Figure 7:
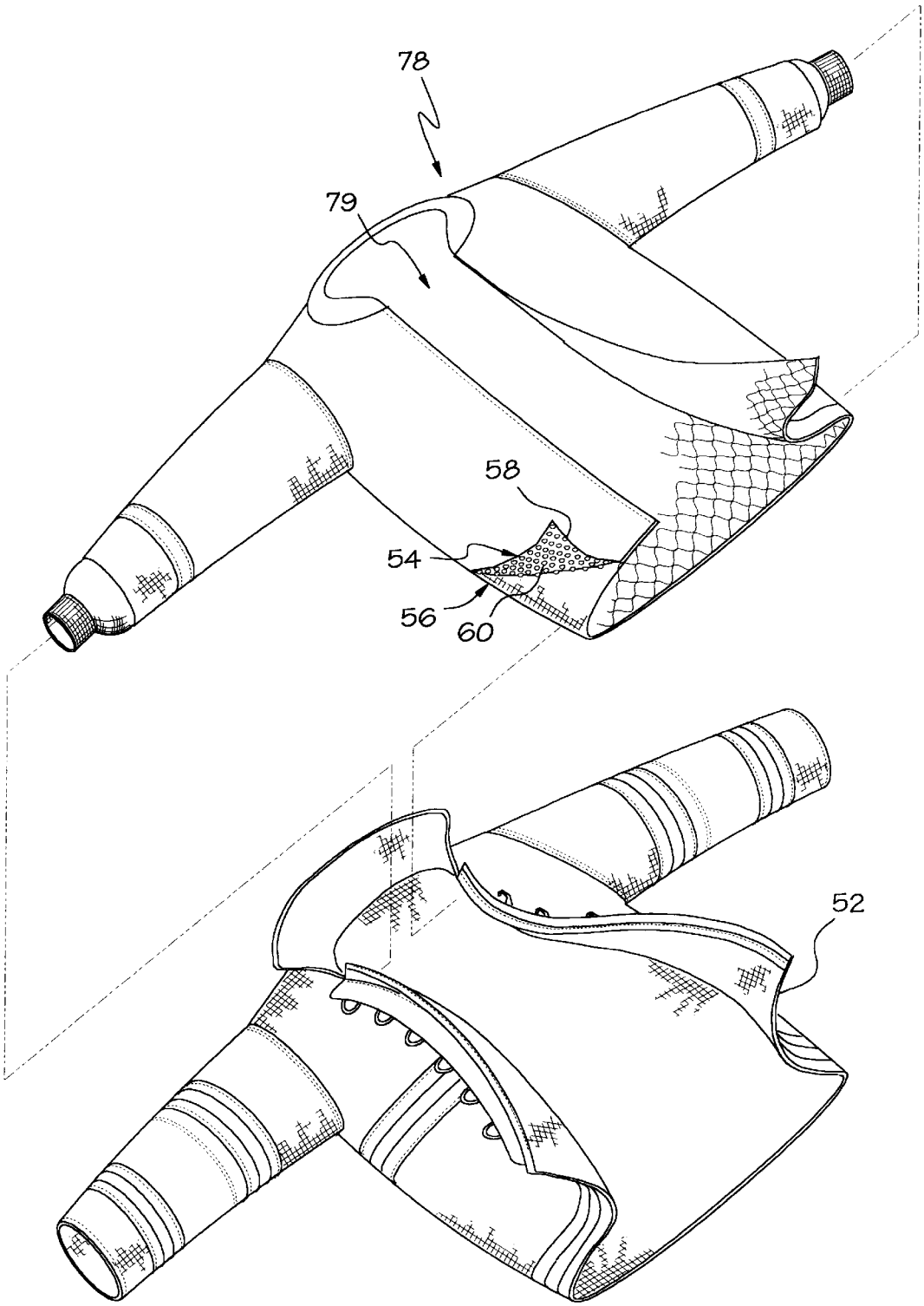
FIG. 7 is an exploded, perspective view of the garment of FIG. 6, wherein the inner liner is separated from the outer shell.

As shown in FIGS. 6 and 7, the thermal liner of the present invention is embodied in a firefighter turnout coat, generally designated 44. The turnout coat 44 comprises a body portion 46, sleeves 48 and a collar 50 attached to the body portion. The coat 44 includes an outer shell 52, a thermal liner 54, and a combination moisture barrier/face cloth 56. The thermal liner 54 is positioned between the outer shell 52 and the moisture barrier/face cloth 56.

The thermal liner 54 includes a fabric substrate 58 and a layer of insulating beads, generally designated 60, bonded to the substrate 58 and sandwiched between the moisture barrier/face cloth 56 and substrate 58. The insulating beads 60 create an air gap 62 (illustrated in FIG. 11) between the moisture barrier/face cloth 56 and the fabric substrate 58 and around the insulating beads 60. As with the embodiment of FIGS. 1–5, the insulating beads 60 preferably are made of polyvinyl chloride, silicone or other suitable material or combinations thereof, provided that the beads are relatively incompressible, and can be in any shape, such as spherical, tear-drop shaped, elliptical, square, rectangular, triangular, so long as air gap is created between the fabric substrate 16 and any adjacent layer of material of the garment 10.

Preferably, the beads 60 have a generally hemispherical shape, a diameter of about 3 millimeters and a height of about 1 mm. The preferred spacing density of the beads 60 on the substrate 58 is in the range from about 5 to 7 beads per square centimeter. The substrate 58 preferably is made of a relatively lightweight aramid material, such as NOMEX or KEVLAR and preferably is woven, although the substrate may alternately be a twill or satin weave. Alternatively, the substrate can be a lightweight cloth of other high heat resistant fiber such as PBI (polybenzamidazole). The weight preferably is in the range of 4–6 ounces per square yard. Although fabric of filament yarn is preferred, spun yarn fabrics, or combinations of spun yarn and filament yarn fabrics may be employed. With such a construction, the thermal liner 54 meets current oven test N.F.P.A. 1971 standards, which include withstanding a temperature of 500° F. for five minutes in a forced circulating air oven without melting, separating or igniting (oven test).

If necessary, successive layers of such a thermal liner 54 may be placed adjacent to each other to provide the requisite thermal protection performance (TPP) factor to meet N.F.P.A. 1971 standards, namely, a TPP of 35 or greater. Alternatively, the insulating beads 60 could be sandwiched between the outer shell 52 and the fabric substrate 58. As shown in FIG. 6, the insulating beads 60 are bonded to the fabric substrate 58 of the thermal liner 54.

The outer shell 52 is constructed of a flame and heat resistant material such as a woven fabric of aramid (such as NOMEX or KEVLAR) and/or PBI fibers. The outer shell 52 further includes a front closure 64 secured by snaps 66 and hook and loop closure components 68, it is within the scope of the invention to use additional closure means such as buttons, slide fasteners and the like. The shell 52 therefore meets the same N.F.P.A. 1971 standards as does the thermal liner 54.

Figure 10:
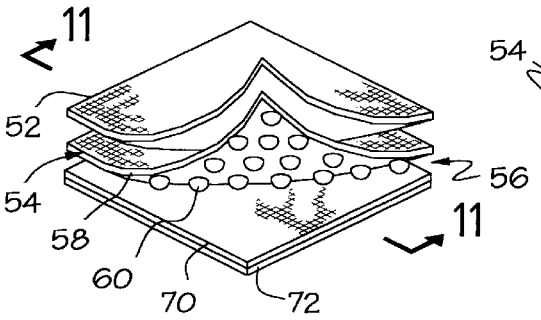
FIG. 10 is a detail of a portion of the garments of FIGS. 6–9.
Figure 11:
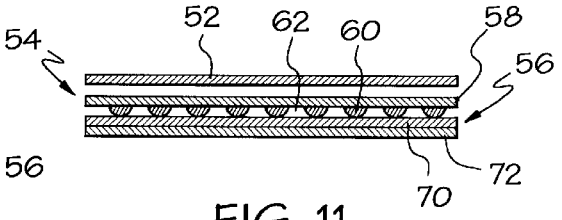
FIG. 11 is a cross sectional view taken at line 11—11 of FIG. 10.

The moisture barrier/face cloth 56 includes a moisture barrier membrane 70, which is moisture vapor permeable but is impermeable to liquid moisture and is wind resistant, bonded to a face cloth 72 (illustrated in FIGS. 10 and 11). The moisture barrier membrane 70 preferably is made of expanded PTFE, more preferably GORE-TEX. The face cloth 72 is made of a lightweight material of aramids such as NOMEX.

The collar 50 of the coat 44 is also provided with a closure or throat tab 74 for securing the collar 50 around the wearer's neck. Reflective strips 76 are stitched to the outer shell 52 at sleeves 48 and body portion 46 to increase visibility in low light conditions.

Preferably, the thermal liner 54 and the moisture barrier/face cloth 56 form an integral liner, generally designated 78, which is removably attached to the outer shell 52 as shown in FIG. 7. Liner 78 is secured to shell 52 by a slide fastener, or hook and loop fasteners (not shown) extending along the periphery of the liner front opening 79.

Additionally, it is within the scope of the present invention that the materials described above for the firefighter turnout coat may be readily substituted with other materials having similar protective properties, or alternative protective properties corresponding to other specialized thermal garments.

Figure 8:
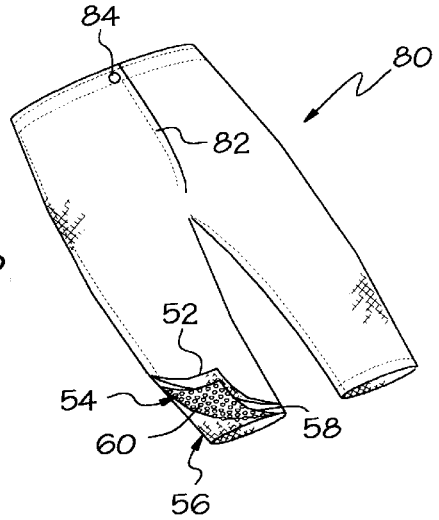
FIG. 8 is a perspective view of a fifth alternate embodiment of the thermal liner of the present invention incorporated in a firefighter pant.

As shown in FIG. 8, the thermal liner 54 is embodied in a firefighter pant, generally designated 80. The pant 80 includes an outer shell 52, a thermal liner 54, and a combination moisture barrier/face cloth 56. The thermal liner 54 is positioned between the outer shell 52 and the combination moisture barrier/face cloth 56. The thermal liner 54 includes a fabric substrate 58 and a layer of insulating beads 60 bonded to the substrate 58 and sandwiched between the combination moisture barrier/face cloth 56 and substrate 58. The insulating beads 60 create an air gap 62 (see FIG. 11) between the moisture barrier/face cloth 56 and the substrate 58 and around the insulating beads 60. The outer shell 52 includes a front closure 82 which is secured by snaps 84. The outer shell 52, moisture barrier/face cloth 56, fabric substrate 58 and insulating beads 60 are made from the same materials and function in the same manner as their corresponding components in the turnout coat 44 described above.

Figure 9:
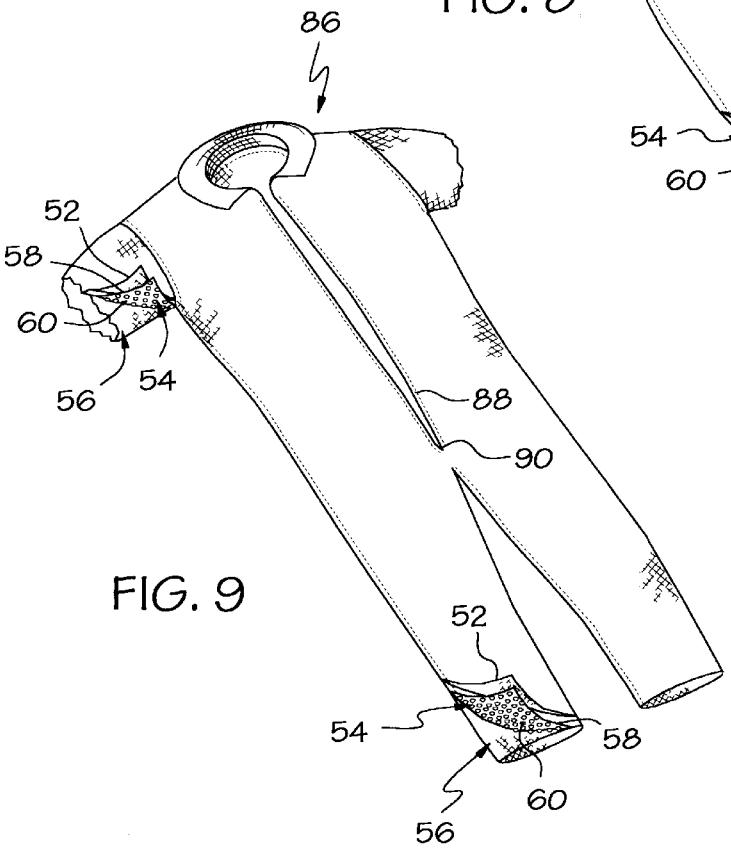
FIG. 9 is a perspective view of a sixth alternate embodiment of the thermal liner of the present invention incorporated in a firefighter coverall or jumpsuit.

As shown in FIG. 9, the thermal liner 54 is embodied in a firefighter coverall, generally designated 86. The coverall 86 includes an outer shell 52, a thermal liner 54, and a combination moisture barrier/face cloth 56. The thermal liner 54 is positioned between the outer shell 52 and the combination moisture barrier/face cloth 56. The thermal liner 54 includes a fabric substrate 58 and a layer of insulating beads 60 bonded to the substrate 58 and sandwiched between the combination moisture barrier/face cloth 56 and substrate 58. The insulating beads 60 create an air gap 62 (see FIG. 11) between the moisture barrier/face cloth 56 and the fabric substrate 58 and around the insulating beads 60. The outer shell 52 includes a front closure 88 which is secured by a slide fastener 90, or alternatively by snaps (not shown). The outer shell 52, combination moisture barrier/face cloth 56, fabric substrate 58 and insulating beads 60 are made from the same materials as their corresponding elements in the turnout coat 44 and pant 80 described above.

FIG. 10 is an enlarged view of a representative cut-away portion of any of the garments in FIGS. 6–9 showing the arrangement of the outer shell 52, the thermal liner 54, including the fabric substrate 58 and the layer of insulating beads 60, and the combination moisture barrier/face cloth 56. An air gap 62, as shown in FIG. 11, is created between the fabric substrate 58 of the thermal liner 54 and the combination moisture barrier/face cloth 56 and around the insulating beads 60. Air gap 62 provides thermal protection to the wearer of the garment from ambient temperature extremes. The shell 52, liner 54 and moisture barrier/facecloth 56 are made of the same materials as their counterparts in the embodiment of FIG. 6.

Figure 12:
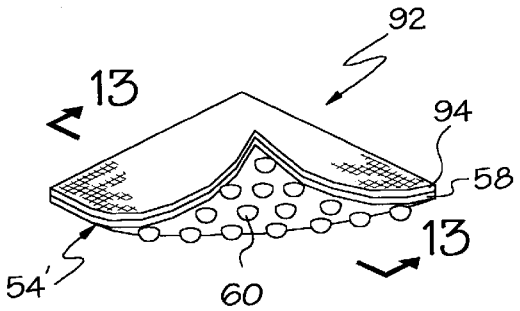
FIG. 12 is a perspective view of a seventh alternate embodiment of the thermal liner of the present invention incorporated in a patch for use with a firefighter garment.
Figure 13:
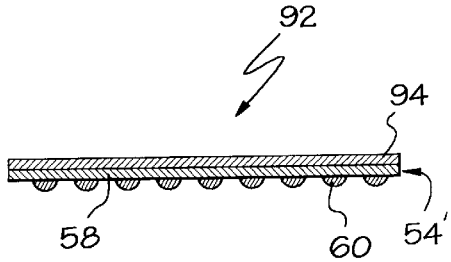
FIG. 13 is a cross sectional view taken at line 13—13 of FIG. 12.
Figure 18:
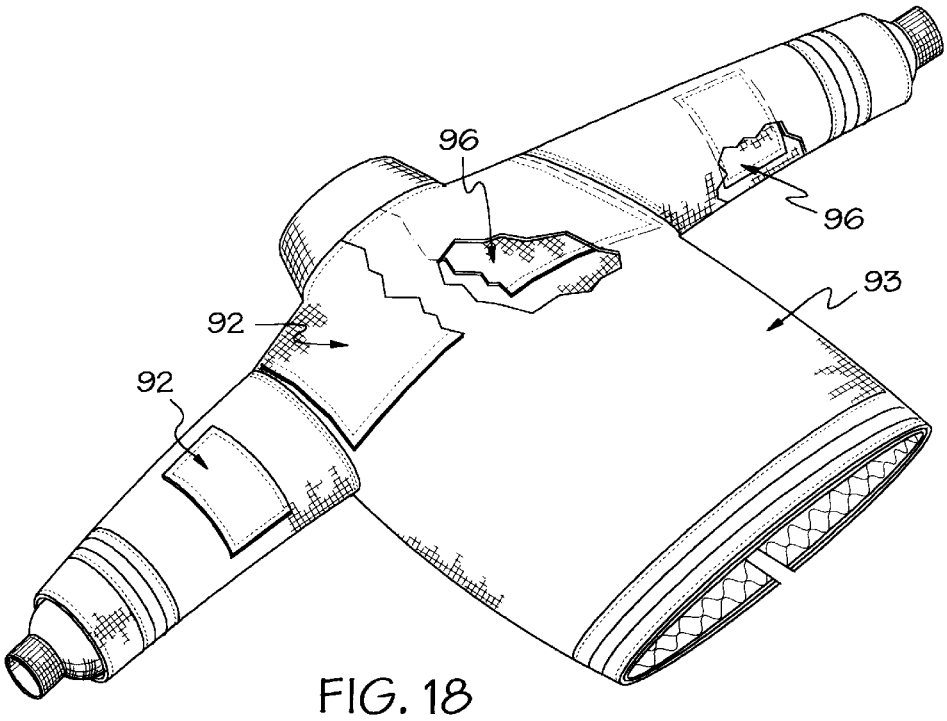
FIG. 18 is a perspective view of the garment of FIG. 6, modified to include the thermal liner of the invention as additional padding in strategic areas according to the invention.
Figure 21:
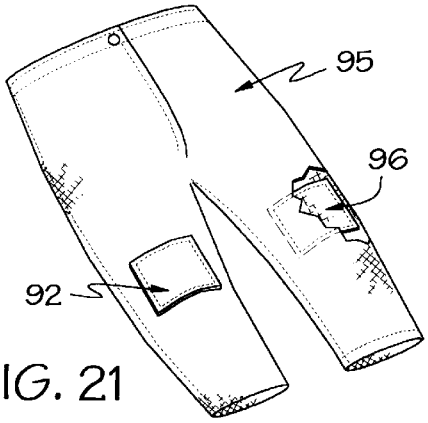
FIG. 21 is a perspective view of the garment of FIG. 8, modified to include additional padding in strategic areas according to the invention.

As shown in FIGS. 12, 13, and 18 the thermal liner of the present invention is incorporated into an external patch, generally designated 92, for use on a firefighting garment 93, which is similar to the turnout coat 44 shown in FIG. 6. The patch 92 comprises an outer shell patch 94 and a patch 54' of thermal liner material. The thermal patch 54' includes a fabric substrate 58 and a layer of insulating beads 60 bonded to the substrate 58. The external patch 92 can be applied to the outer surface of the outer shell 52 of the firefighting garment 93 and positioned in strategic locations, such as the elbow, shoulder yoke or knees of the garment, also as shown in FIG. 21 for a turnout pant 95, which is similar in construction to coat 44 of FIG. 6. The insulating beads 60 create an air gap either between the outer shell patch 94 and the fabric substrate 58, or between the outer shell 52 of the garment 93 or 95 and the fabric substrate, depending upon the orientation of the liner 54'. The outer shell patch 94 can be made from leather, or shell material, such as aramid, PBI or a combination thereof. The fabric substrate 58 and insulating beads 60 are made from the same materials as their corresponding elements in the thermal liner 54 of FIG. 6.

Figure 19:
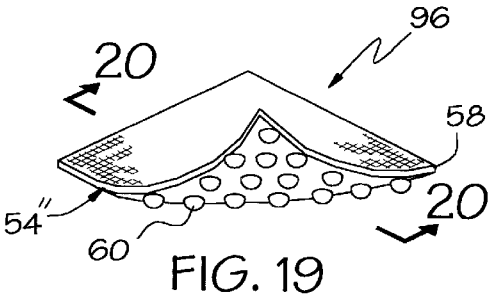
FIG. 19 is a perspective view of the thermal liner of the present invention as a pad for use in a firefighter garment in accordance with the present invention.
Figure 20:
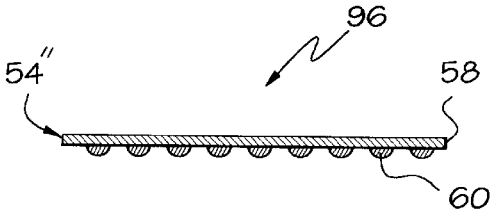
FIG. 20 is a cross sectional view taken along line 20—20 of FIG. 19.

As shown in FIGS. 19 and 20, the thermal liner 54" is incorporated into an internal pad, generally designated 96, for use in a firefighting garment 93, shown in FIG. 18. The thermal liner 54" includes a fabric substrate 58 and a layer of insulating beads 60 bonded to the substrate 58. The pad 96 is preferably positioned between the outer shell 52 and thermal liner 54 of the garment in strategic locations, such as the elbow, shoulder yoke or knees, as shown in FIGS. 18 and 21. The insulating beads 60 create air gaps between either the outer shell 52 of the firefighting garment and the fabric substrate 58 or the thermal liner 54 of the firefighting garment and the fabric substrate 58 depending upon the orientation of the liner 54". The fabric substrate 58 and insulating beads 60 are made from the same materials as their corresponding elements in the firefighting turnout coat, pant and coveralls, described above with reference to FIGS. 6 and 7 and generally provide the same function, adding increased thermal and abrasion resistance in areas of high compression.

Figure 14:
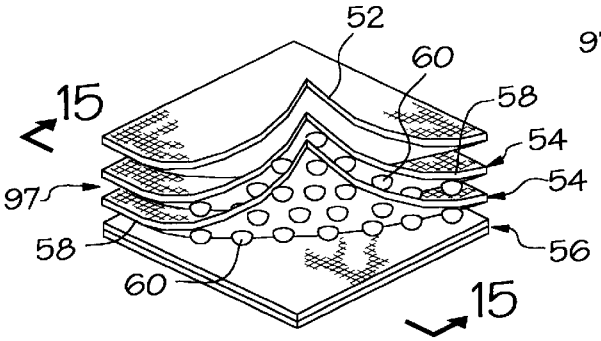
FIG. 14 is an eighth alternate embodiment of the thermal liner of the present invention showing a detail of the thermal liner in a portion of a garment similar to the garments of FIGS. 6–9.
Figure 15:
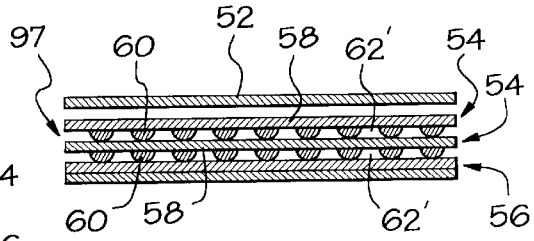
FIG. 15 is a cross sectional view taken at line 15—15 of FIG. 14.

As shown in FIGS. 14 and 15, a representative cut-away portion of a garment, such as the garment 44 of FIG. 6, is modified to include a thermal liner 97 having several layers 54, each having a fabric substrate 58 and a plurality of insulating beads 60 bonded thereto. This composite thermal liner 97 is positioned between the outer shell 52 and the combination moisture barrier/face cloth 56. An air gap 62', shown in FIG. 15, is created around the insulating beads 60 of each layer 54 and between adjacent fabric substrates 58 and between an outer fabric substrate 58 and the moisture barrier/face cloth 56 (or outer shell 52, depending upon orientation).

Figure 16:
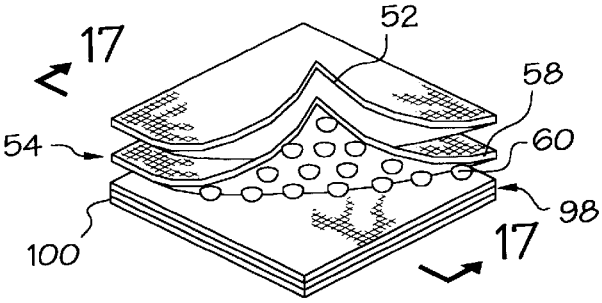
FIG. 16 is a detail showing a portion of the garment of FIG. 10, modified to include an additional face cloth.
Figure 17:
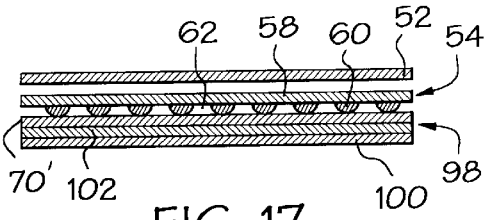
FIG. 17 is a cross sectional view taken at line 17—17 of FIG. 16.

As shown in FIGS. 16 and 17, a representative cut-away portion of a garment similar to garment 44 of FIG. 6 is modified from the construction shown in FIGS. 10 and 11 in the following manner. The combination moisture barrier/face cloth 56 (see FIGS. 10 and 11) is replaced with two discrete components: a moisture barrier 98 and a face cloth 100. The moisture barrier 98 includes a substrate 102 and a moisture barrier membrane 70' bonded to the substrate 102. The substrate 102 is preferably made of a flame and heat resistant material such as the aramid or PBI material of the outer shell, only lighter in weight. The moisture barrier membrane 70' and the face cloth 100 are made from the same materials as their corresponding elements in the embodiments described above.

Figure 22:
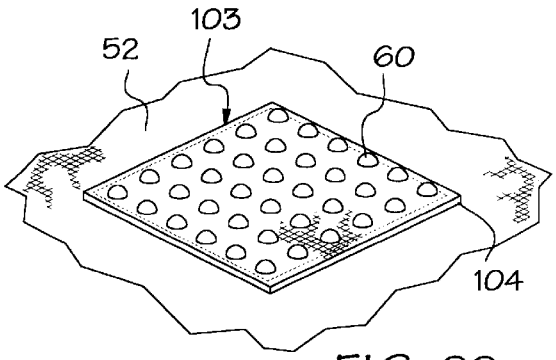
FIG. 22 is a perspective view of an external patch in accordance with the present invention shown mounted on a firefighting garment.

As shown in FIG. 22, the thermal liner of the present invention is in the form of an external patch 103 for use on firefighting garments comprising a fabric substrate 104 and a layer of insulating beads 60 bonded to the fabric substrate 104 such that the beads 60 are facing outward, away from the outer shell 52 of a firefighting garment 44. The fabric substrate 104 preferably is made from aramid fibers, but can be made from leather or PBI, or other flame and heat resistant material. The insulating beads are made from the same materials as described above. By positioning the insulating beads 60 to face outwardly, away from the outer shell 52 of the firefighting garment, the life of the firefighting garment, especially in areas of high stress, such as the knees, shoulder yoke and elbows, may be prolonged.

Having described the invention in detail and by reference to the drawings, it will be apparent that modifications and variations are possible without departing from the scope of the invention as defined in the following claims.

What is claimed is:

1. A garment comprising:

a layer of material; and a thermal liner adjacent to the layer of material, including a fabric substrate and a layer of discrete beads of material applied in a spaced array to said fabric substrate, said beads being unattached to said adjacent layer of material and having a shape which narrows with the distance from said fabric substrate such that open areas of said fabric substrate are formed between said beads providing an insulating air gap around said beads.

2. The garment of claim 1, wherein said beads are bonded to said fabric substrate.

3. The garment of claim 1 wherein said beads are relatively incompressible.

4. A garment comprising:

a layer of material; and a thermal liner, not attached to, but adjacent to the layer of material, including a layer of discrete beads of material applied in a spaced array to a fabric substrate such that open areas of said fabric substrate are formed between said beads so that an insulating air gap is formed around said beads;

wherein said beads are made from a material selected from the group consisting of polyvinyl chloride, silicone or combinations thereof.

5. A garment comprising:

an outer shell;

a combination moisture barrier/face cloth; and a thermal liner positioned between said outer shell and said moisture barrier/face cloth, said thermal liner including at least one layer of spaced insulating beads positioned between said outer shell and said moisture barrier/face cloth such that an insulating air gap is formed around said beads, said beads being unattached to an adjacent one of said outer shell and moisture barrier/face cloth and having a shape which narrows with the distance towards said adjacent one of said outer shell and moisture barrier/face cloth.

6. The garment of claim 5 wherein said thermal liner includes a fabric substrate, and said beads are bonded to said substrate, said thermal liner being oriented such that an insulating gap is created between said substrate and said moisture barrier/face cloth around said insulating beads.

7. The garment of claim 6 wherein said substrate is made of a flame and heat resistant material.

8. The garment of claim 7 wherein said thermal liner resists melting, dripping or ignition when exposed to a temperature of 500° F. for five minutes.

9. The garment of claim 8 wherein said fabric of said substrate is made of a material selected from the group consisting of aramid fibers and PBI fibers.

10. The garment of claim 6 wherein said substrate is constructed from a material which is capable of withstanding 500° F. for five minutes without melting, separating or igniting.

11. The garment of claim 10 wherein said substrate includes fibers selected from the group consisting of aramid and PBI fibers.

12. The garment of claim 5 wherein said beads are relatively incompressible.

13. A garment comprising:

an outer shell;

a combination moisture barrier/face cloth; and a thermal liner positioned between said outer shell and said moisture barrier/face cloth, said thermal liner including at least one layer of spaced insulating beads positioned between said outer shell and said moisture barrier/face cloth such that an insulating air gap is formed around said beads;

wherein said beads are made from a material selected from the group consisting of polyvinyl chloride, silicone or combinations thereof.

14. A garment comprising:

an outer shell;

a combination moisture barrier/face cloth; and a thermal liner positioned between said outer shell and said moisture barrier/face cloth, said thermal liner including at least one layer of spaced insulating beads positioned between said outer shell and said moisture barrier/face cloth such that an insulating air gap is formed around said beads;

wherein said combination moisture barrier/face cloth includes a semi-permeable membrane material and a face cloth substrate; and wherein said membrane material includes expanded polytetrafluoroethylene.

15. A garment comprising:

an outer shell layer;

a face cloth layer;

a thermal liner, positioned between said outer shell and said face cloth, said thermal liner including a layer of insulating beads positioned between said outer shell and said face cloth; and a moisture barrier layer positioned between said outer shell and said face cloth wherein said thermal liner is positioned adjacent to, but is not attached to, at least one of said outer shell layer, face cloth layer and moisture barrier layer such that an insulating air gap is formed around said beads and between said thermal liner and selected adjacent one of said layers of said garment.

16. The garment of claim 15 wherein said thermal liner includes a fabric substrate.

17. The garment of claim 16 wherein said insulating beads are attached to said fabric substrate such that an air gap is created between said substrate and said moisture barrier layer and around the said beads.

18. The garment of claim 17 wherein said beads are bonded to said substrate.

19. The garment of claim 16 wherein said substrate is made of a flame and heat resistant material.

20. The garment of claim 19 wherein said material is selected from the group consisting of aramid and PBI fibers, and combinations thereof.

21. The garment of claim 20 wherein said thermal liner is made of a material selected from the group consisting of aramid and PBI fibers, and combinations thereof.

22. The garment of claim 16 wherein said substrate is constructed from a material which is capable of withstanding 500° F. for five minutes without melting, separating or igniting.

23. The garment of claim 15 wherein said beads are relatively incompressible.

24. The garment of claim 15 wherein said beads include material selected from the group consisting of polyvinyl chloride, silicone and combinations thereof.

25. The garment of claim 15 wherein said moisture barrier layer includes a moisture barrier membrane bonded to a substrate.

26. The garment of claim 25 wherein said membrane is made from expanded polytetrafluoroethylene.

27. A method of manufacturing a firefighter garment comprising the steps of:

selecting an outer shell of abrasion resistant material;

selecting a moisture barrier and placing said moisture barrier within said shell; and selecting a thermal liner including a fabric substrate and a layer of insulating beads attached to said substrate; and positioning the thermal liner within said outer shell such that the thermal liner is adjacent to at least one of said outer shell layer and moisture barrier layer, such that an insulating air gap is formed around said beads and between said thermal liner and said adjacent one of said outer shell layer and moisture barrier layer;

said beads being unattached to said adjacent one of said outer shell layer and moisture barrier layer and having a shape which narrows with the distance from said fabric substrate.

28. The method of claim 27 wherein said substrate is made from a material selected from the group consisting of aramid fibers, PBI fibers and combination thereof.

29. The method of claim 27 wherein said substrate is constructed from a material which is capable of withstanding 500° F. for five minutes without melting, dripping, separating or burning.

30. The method of claim 27 wherein the insulating beads are relatively incompressible.

31. A method of manufacturing a firefighter garment comprising the steps of:

selecting an outer shell of abrasion resistant material;

selecting a moisture barrier and placing said moisture barrier within said shell; and selecting a thermal liner including a fabric substrate and a layer of insulating beads attached to said substrate; and positioning the thermal liner within said outer shell such that the thermal liner is adjacent to, but not attached to, at least one of said outer shell layer and moisture barrier layer, such that an insulating air gap is formed around said beads and between said thermal liner and selected adjacent one of said layers of said garment;

wherein said beads are made from a material selected from the group consisting of polyvinyl chloride, silicone or combinations thereof.

32. A garment comprising:

an outer shell; and a thermal liner positioned within the outer shell and including a layer of spaced insulating beads made from a material selected from the group consisting of polyvinyl chloride, silicone or combinations thereof such that an insulating air gap is formed around said beads.

33. A garment comprising:

an outer shell;

a face cloth;

a thermal liner, positioned between said outer shell and said face cloth, said thermal liner including a layer of insulating beads that include material selected from the group consisting of polyvinyl chloride, silicone and combinations thereof positioned between said outer shell and said face cloth; and a moisture barrier positioned between said outer shell and said face cloth.

34. A method of manufacturing a firefighter garment comprising the steps of:

selecting an outer shell of an abrasion resistant material;

selecting a moisture barrier and placing said moisture barrier within said shell; and selecting a thermal liner including a fabric substrate and a layer of insulating beads made from a material selected from the group consisting of polyvinyl chloride, silicone or combinations thereof attached to said substrate.

35. A firefighter garment comprising:

an outer shell;

a combination moisture barrier/face cloth; and a thermal liner positioned between said outer shell and said moisture barrier/face cloth, said thermal liner including at least one layer of spaced insulating beads positioned between said outer shell and said moisture barrier/face cloth such that an insulating air gap is formed around said beads, said beads being unattached to an adjacent one of said outer shell and moisture barrier/face cloth and having a shape which narrows with the distance towards said adjacent one of said outer shell and moisture barrier/face cloth.

36. A garment comprising:

a layer of material; and a thermal liner positioned adjacent to the layer of material including a layer of discrete beads of material applied in a spaced array to a fabric substrate such that open areas of said fabric substrate are formed between said beads so that an insulating air gap is formed around said beads and between said thermal liner and layer of material, wherein said beads are dome-shaped such that the surface area of contact with said layer of material is minimized to promote moisture vapor transport through said insulating air gap.

37. A garment comprising:

an outer shell layer;

a face cloth layer;

a moisture barrier layer positioned between said outer shell layer and said face cloth layer; and a thermal liner, positioned between said outer shell layer and said face cloth layer, said thermal liner including fabric substrate and a layer of insulating beads attached to a surface of said substrate forming a beaded surface of said substrate;

said thermal liner being positioned adjacent to at least one of said outer shell layer, face cloth layer and moisture barrier layer, said beaded surface of said substrate facing said adjacent layer and said beads being unattached to said adjacent layer, thereby forming an insulating air gap around said beads and between said thermal liner and said adjacent layer.

38. The garment of claim 37, wherein said beads have a shape which narrows with the distance from said surface of said substrate.

39. The garment of claim 38, wherein said beads are substantially half-spherically shaped and are bonded to said surface of said substrate.

40. The garment of claim 37, wherein said beads are positioned on said surface of said substrate in a spaced array.

41. The garment of claim 37, wherein said substrate is constructed from a flame and heat resistant material.

42. The garment of claim 37, wherein said beads are made from a material selected from a group consisting of polyvinyl chloride, silicone or combinations thereof.

* * * * *